US005644335A

United States Patent [19]

Mielekamp

[11] Patent Number: 5,644,335

[45] Date of Patent: Jul. 1, 1997

[54] METHOD FOR THE GRAPHIC REPRODUCTION OF A SYMBOL WITH AN ADJUSTABLE SCALE AND POSITION

[75] Inventor: Pieter M. Mielekamp, Eindhoven, Netherlands

[73] Assignee: U.S. Philips Corporation, New York, N.Y.

[21] Appl. No.: 470,581

[22] Filed: Dec. 21, 1993

Related U.S. Application Data

[63] Continuation of Ser. No. 808,337, Dec. 16, 1991, abandoned.

[30] Foreign Application Priority Data

Dec. 21, 1990 [NL] Netherlands ..... 9002843

[51] Int. Cl.[6] ..... G09G 5/00

[52] U.S. Cl. ..... 345/127; 345/147; 382/274

[58] Field of Search ..... 345/121, 124, 345/127, 128, 129, 130, 141, 144, 147; 382/254, 266, 274, 260, 263, 270

[56] References Cited

U.S. PATENT DOCUMENTS

| | | | |
|---|---|---|---|
| 4,851,825 | 7/1989 | Naiman | 340/728 |
| 4,945,351 | 7/1990 | Naiman | 340/793 |
| 4,996,593 | 2/1991 | Hopkins | 382/22 |
| 5,161,205 | 11/1992 | Moran et al. | 382/22 |

*Primary Examiner*—Regina D. Liang
*Attorney, Agent, or Firm*—Robert J. Kraus

[57] ABSTRACT

The invention relates to the graphic reproduction of symbols on an imaging surface. These symbols can be controlled as regards position and/or scale. They are reproduced as successions of brightness values arranged in image lines. As a result of the use of brightness values between levels occurring in an ideal brightness profile of the symbol (for example, only black and white), high-resolution details are reproduced. In accordance with the invention, boundaries between successive image lines are used to reproduce transitions between the brightness levels as sharply as possible.

27 Claims, 3 Drawing Sheets

METHOD FOR THE GRAPHIC REPRODUCTION OF A SYMBOL WITH AN ADJUSTABLE SCALE AND POSITION

This is a continuation of prior application Ser. No. 07/808,337, filed on Dec. 16, 1991 now abandoned.

BACKGROUND OF THE INVENTION

The invention relates to a method for the reproduction of a symbol with an adjustable scale and/or an adjustable position on an imaging surface by means of successions of brightness amplitudes which are arranged in the image lines of an image raster on the imaging surface, one of at least three values being used for each brightness amplitude, each brightness amplitude corresponding to a low-pass spatially filtered amplitude of an ideal brightness profile of the symbol, sampled on a sampling grid comprising sampling lines with a pitch which is controlled relative to the ideal brightness profile by the adjusted scale and/or with an offset which is controlled relative to the ideal brightness profile by the adjusted position with an accuracy amounting to a fraction of the pitch. The invention also relates to a device for performing such a method.

A method of the kind set forth is known from A. Naiman, A. Fournier, "Rectangular convolution for fast filtering of characters", Computer Graphics, Vol. 21, No. 4 (July 1987), pp. 233–242. According to the cited method, the brightness profile expressed in a symbol description with high-resolution information is converted into successions of brightness amplitudes, each of which is arranged in a line on an image raster. When use is made of, for example a page description language such as POSTSCRIPT (R) (a trade mark owned by ADOBE), which is described in the "Postscript language reference manual", Adobe systems, Addison Wesley publishing company, Reading Massachusetts, 1985, ISBN 0-201-10174-2, the ideal brightness profile is described by a number of mathematical curves which represent, for example the edge between "black" and "white" in a letter symbol. The curves themselves are defined by parameters. This kind of description has an infinitely high resolution; this is what is meant by ideal. The ideal brightness profile can alternatively be described by way of a master grid of brightness amplitudes, the brightness profile on the master grid then being ideal in a sense that its resolution is higher than that of the sampling grid. Generally speaking, an ideal brightness profile is to be understood to mean any brightness representation which contains more detailed information than the ultimate succession of brightness amplitudes.

When a page description language is used, moreover, the position and scale of symbols to be reproduced can be highly accurately indicated. Thus, a symbol to be reproduced will be specified independent of the image display device, and one does not need to take its properties into account in the specification. The ideal symbols defined in the page description language cannot be reproduced exactly on simple image display devices, which, of course, have only limited resolution. However, according to the known symbol reproduction method, the resolution of preceived details can be improved in known devices by utilizing more than two brightness amplitude values, even though the brightness profiles themselves are actually bivalent, for example typographic symbols such as letters, digits etc. which have a foreground brightness value for "inked" segments and a background value against which these segments are reproduced ("black" and "white", respectively in printed text).

In order to improve the perceived resolution, the known method utilizes the known fact that the human visual system does not interpret brightness values between the foreground value and the background value in otherwise bivalent patterns as brightness values per se but rather as high-resolution details. Thus, an image line having a width of one raster line and a brightness value halfway between the foreground value and the background value is interpreted as a line having a width of one half pixel against the background. A stepped brightness profile comprising image lines having background values to one side of the step, image lines having foreground values to the other side of the step, and at the edge therebetween an image line having a brightness value halfway the foreground value and the background value is interpreted as a stepped profile halfway the image line therebetween.

Although the cited article by Naiman and Fournier, restricts the method to the use of grey values as brightness amplitudes, it will be evident that this restriction is not essential; for example, colour amplitudes and combinations thereof can also be treated in this manner. The devices in which the described method is carried out need not be restricted to CRTs either; the method can be used in any device capable of reproducing images with more than two brightness amplitudes, for example LCDs and printers.

It is a drawback of the known method that the prevention of artifacts, i.e. perceived deviations from the desired brightness profile, necessitates a complex operation so as to extract the succession of brightness amplitudes from the brightness profile of a symbol. This is especially disadvantageous since it is necessary to take into account properties of the display panel; for example, in the case of a CRT it is necessary to take into account the linearity of the phosphor and the shape of the pixels which differ from one type of semen to another and sometimes even from one screen to another. Therefore, usually artifacts remain: the symbols are perceived as being unsharp, the baseline on which typographic symbols rest is perceived to be undulating, and so is the top line (x-height) extending along the tops of the typographic symbols. As a result, the reading of the screen is more fatiguing than the reading of conventional printed matter.

SUMMARY OF THE INVENTION

It is inter alia an object of the invention to enhance the perceived sharpness and linearity in a simple manner which requires only limited knowledge of the screen properties.

This object is achieved by the method for reproducing symbols by the concentration of a spatial variation of the brightness amplitude between two successive image lines of the image raster, which variation corresponds to an edge in the brightness profile between a background brightness level and an internal brightness level of the symbol, which edge extends parallel to the sampling lines, concentration being achieved by adaptation of the pitch and/or the offset. The boundary between two neighbouring image lines is thus used to optimize the sharpness of the spatial brightness variation. Experiments have demonstrated that the sharpness perceived is thus enhanced, because the human visual system is primarily adapted to perceive edges rather than details having a high spatial frequency in general.

The extent of concentration of the brightness variation between two successive lines is determined by the relative position of successive sampling lines with respect to the edge in the brightness profile. It can be directly influenced by readjustment of the offset of the sampling grid or by readjustment of the pitch of the sampling grid; in the latter case, only one sampling line retains its position, the other sampling lines being shifted with respect to the brightness profile so that their position with respect to the edge also changes. The brightness variation can be concentrated between a pair of successive lines also in this manner. Evidently, the same effect can be obtained by shifting or scaling the brightness profile relative to the grid.

Successful application of the invention merely requires sampling lines: sampling on pixels within the lines, as is inevitable in, for example LCD displays, is not necessary and in a CRT display device an analog low-pass filter without sampling on pixels could suffice for the low-pass filtering.

It is to be noted that the invention is explicitly restricted to a method for reproduction where the position is adjustable with an accuracy amounting to fractions of the distance between successive image lines and/or where the scale is adjustable with an accuracy greater than afforded by integer factors. Known methods where symbols are reproduced by way of binary patterns on the image lines and where the symbols are to be reproduced simply offset by one image line or upscaled an integer number of times are thus excluded.

A version of the method in accordance with the invention is characterized by the concentration of two spatial variations, corresponding to two parallel edges in the brightness profile which also extend parallel to the sampling lines, concentration being achieved by combined adaptation of pitch and offset. For example, for typographic symbols the lower side (baseline) and the upper side (x-height) are thus simultaneously rendered sharp. A further version of the method in accordance with the invention is characterized by a transverse concentration of a spatial transverse variation in brightness amplitude between two successive transverse sampling lines, which transverse variation corresponds to a transverse edge in the brightness profile between a background brightness level and an internal brightness level in the symbol, which transverse edge extends parallel to the transverse sampling lines, transverse concentration being achieved by adaptation of a transverse pitch and/or transverse offset of the sampling grid relative to the brightness profile.

In order to execute low-pass filtering and to cope with the properties of many image display devices, it is advantageous to sample also on individual sampling points within a sampling line. In conjunction with the sampling points on other sampling lines, such sampling points themselves constitute transverse lines on which successive sampling points are arranged. When the method in accordance with the invention is executed twice, i.e. once between the lines and once on the transverse lines, two transversely extending edges can be rendered sharp.

A further version of the method in accordance with the invention, where the symbol is a typographic symbol, i.e. a letter, a digit, a line or any other character used in printing, is characterized in that a baseline and/or an upper side (x-height) of the typographic symbol is used as a relevant edge. Notably for typographic symbols to be intensely observed a sharp edge which contributes to reduction of reading fatigue is advantageous.

A further version of the method in accordance with the invention is characterized in that a side line of the typographic symbol is used as a relevant edge. A further version of the method in accordance with the invention is characterized in that the typographic symbol is reproduced together with a series of typographic symbols, the spatial variation being concentrated between the same two successive image lines for each of the symbols of the series. The perceived line straightness is enhanced by situating the edge of successive symbols each time between the same pair of successive image lines.

Another version of the method in accordance with the invention is characterized in that the brightness profile is combined with an indication of a reference line which corresponds to the edge in the brightness profile, the pitch and/or the offset being adapted so that the reference line is situated halfway between two successive sampling lines. Thus it is not necessary to determine the position of the edge for each symbol individually.

A further version of the method in accordance with the invention is characterized in that the symbol is selected from a set of symbols, each of which is associated with its own brightness profile, said symbols having a common reference line. The method can thus be uniformly applied to all symbols of the set.

A version of the method in accordance with the invention where the image raster is repeatedly reproduced in the reproduction mode, each time a first part of the image lines being reproduced and subsequently a second part of the image lines, the image lines of the first part being interlaced with the image lines of the second part, is characterized in that said concentration is realised between two successive lines of the first part. In many image display devices, for example standard television screens, images are reproduced in an interlaced fashion: a first part of the image lines and a second part of the image lines are alternately reproduced, the image lines of the first part being situated between those of the second part. The main object is to counteract flicker caused by the fact that the individual repetitions of image lines are perceived. In this type of reproduction device it is advantageous to concentrate the brightness step between two image lines of one part of the image lines; thus, an interlaced image line will have a brightness amounting to the mean value of the adjacent image lines. However, if the step were concentrated between an image line of the first part and an image line of the second part, the step would be perceived as more disturbing local flicker at the edge of the symbol. A further version of the method in accordance with the invention is characterized in that adaptation is performed so that at the edge an intermediate image line of the second part has a mean brightness amplitude between the two successive lines of the first part.

BRIEF DESCRIPTION OF THE DRAWINGS

These and other advantages of the method in accordance with the invention will be described in detail hereinafter with reference to some-figures; therein

DESCRIPTION OF THE PREFERRED EMBODIMENTS

Figure 1:
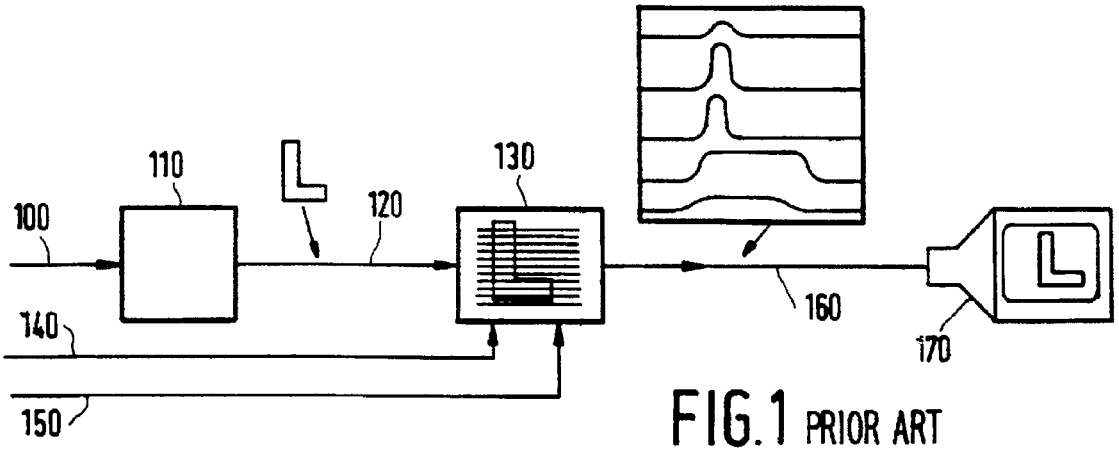
FIG.1 PRIOR ART
FIG. 1 shows a device for performing the prior art method.

FIG. 1 shows a device which is suitable for performing a prior art method for reproducing symbols. Therein, in response to a symbol indication presented to an input 100 the symbol is reproduced by means of a display screen 170. The effect persued will be described in detail with reference to the FIGS. 2 and 3, but first the device shown in FIG. 1 will be described.

In the device shown in FIG. 1, first a description of the brightness profile, for example of a letter "L" is produced (120). Subsequently, the brightness profile is subjected to a low-pass spatial filtering operation and is sampled on a grid of sampling lines (130). The offset of the sampling grid and its pitch are controlled by an externally adjusted position (140) and scale (150) of the symbol to be reproduced. The sampling result (160) is applied to the display screen.

The device described with reference to FIG. 1 represents merely an embodiment. For example, the input signals 100, 140, 150 can also be generated by execution of a program, for example in POSTSCRIPT (R) instead of via separate signals, a symbol code, a position code and a scale code instruction then being successively processed. The position and the scale can also be adjusted independently of the symbol, for example once for an entire line of text. The symbols and associated brightness profiles can be presented each time via 100, but 110 could also be capable of storing the profiles so that each time only a selection signal via the input 100 is required. The brightness profile may be represented as a matrix of brightness values (a so-called bit map), for example a letter "L", or as a contour description in terms of a series of mathematical curves. It will be evident that many alternatives are feasible for the inputs.

Once the brightness profile, the scale and the position come together (130), a spatial low-pass filtered and sampled set of image lines should be produced. Again different embodiments are feasible in this respect. For example, the image may be subdivided into pixels, the filtered value being numerically calculated for each pixel. Alternatively, for each brightness profile previously calculated sampled and filtered values can be stored for a series of scale and position combinations, so that the unit 130 need merely look up values. It is not necessary to sample on pixels: it suffices to sample on image lines, the filtering along the line, for example using an analog filter, thus being performed continously instead of on individual pixels.

Finally, the image display device need not be restricted to a CRT with black-white-grey images: colour reproduction or other reproduction techniques such as LCD or printer mechanisms can also be used.

Figure 2:
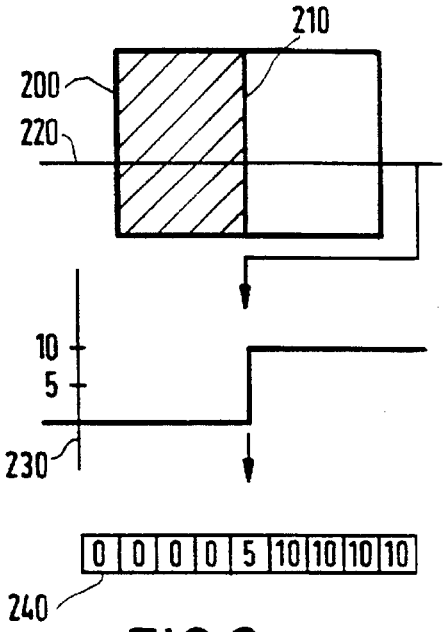
FIG.2 PRIOR ART
FIG. 2 illustrates the prior art principle on the basis of a brightness profile comprising an edge.

FIG. 2 illustrates the principle on which the prior art device is based. Proceeding from the top downwards, the Figure shows a brightness profile 200 comprising an edge 210, a graph 230 showing the brightness as a function of the position along a cross-section 220 in the brightness profile 200, and finally a series of brightness samples 240 representing the step. In this respect it is to be noted that the series is assumed to be repeated in the vertical direction. Because the brightness sample corresponding to the edge 210 has a magnitude 5, which is halfway between those for the samples representing the brightnesses to the left and to the right of the edge, 210, this central sample represents an edge.

Figure 3:
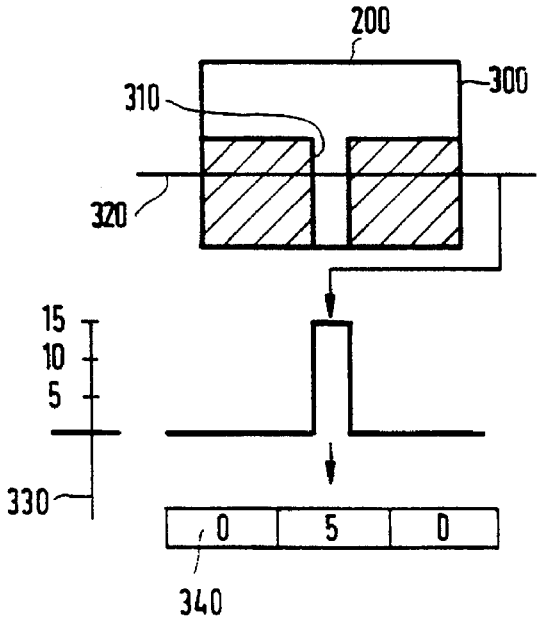
FIG.3 PRIOR ART
FIG. 3 illustrates the prior art principle on the basis of a brightness profile comprising a thin line.

FIG. 3 illustrates the principle on the basis of a brightness profile comprising a line. Therein, a brightness sample having a magnitude equal to one third of the brightness of the profile 300 suggests a line having one third of the width of the sampling point.

When use is made of brightness values other than those occurring in the profile, for example in the case of binary brightness profiles such as of letters having more than two brightness values, details that cannot be represented by binary samples are thus suggested. For example, letters which would be mutilated beyond recognition on low-resolution sampling grids can thus still be reproduced with a reasonable quality.

Even though the choice of the sampled brightness values is comparatively simple in the FIGS. 2 and 3, in practice a problem is still encountered. An incorrect choice of the filtering leads to the observation of artifacts, i.e. details which do not occur in the brightness profile. For a correct choice of the filtering it is necessary to compensate for the effects occurring along the entire imaging path from the reproduction device to the human eye, for example the shape of the pixels used on the screen, the linearity of the phosphor used, etc. In practice rather complex filters are thus required and artifacts will still occur.

It is an object of the invention to enable the use of rather simple filters, without giving rise to disturbing artifacts. The invention is based on the recognition of the fact that notably the sharpness of outer edges of symbols is important to the perception. In order to enhance this sharpness, it is ensured that the outer edges coincide with the boundary between successive image lines of the image raster. This is realised by adaptation of the offset and/or pitch of the raster.

Figure 4A:
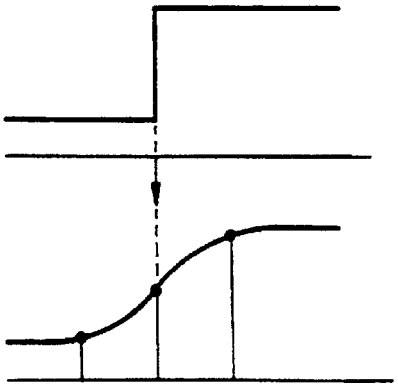
FIG.4a PRIOR ART
FIGS. 4*a*, 4*b*, 4*c* and 4*d* illustrate the concentration of a brightness step by adaptation of the offset of a sampling grid.
Figure 4B:
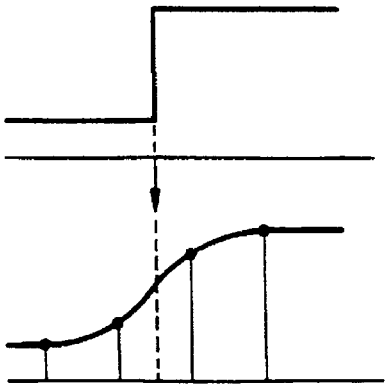

FIGS. 4*a*, *b* illustrate this process. The upper part of FIG. 4*a* shows a graph of a brightness profile containing an edge. Therebelow a low-pass filtered version of this profile is shown. In the graph of FIG. 4*a* three sampling points are indicated, the central sampling point coinciding with the edge. Consequently, the brightness distribution is distributed between two pairs of sampling points from left to right. FIG. 4*b* shows the situation pursued by the invention: the brightness variation is concentrated between two sampling points. Because the successive samples are reproduced on successive individual image lines, a sharp edge will thus be produced on the display screen. This is highly desirable notably when the ideal brightness profile has a sharp edge. Even though the brightness profile has only two brightness levels in the present example, it will be evident that the principle remains the same when the brightness profile also assumes other internal brightness levels in locations other than in the vicinity of the edge.

Figure 4C:
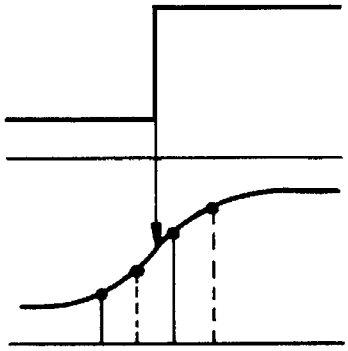
FIG. 4c PRIOR ART
Figure 4D:
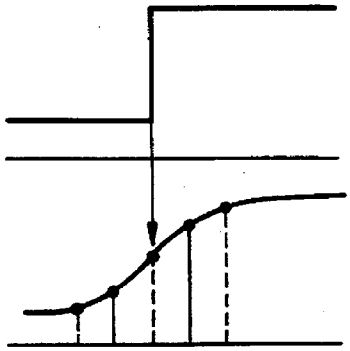

FIGS. 4*c*, 4*d* show the same principle for interlaced images. In many image display devices the image is displayed in a periodically recurrent fashion. For example, in the case of cathode ray tubes this is necessary so as to obtain a permanent brightness impression. Interlacing is often applied: for example, in Europe the image on the television screen is repeated every 40 ms, half the number of image lines being written in an alternating fashion, each half during 20 ms, the image lines of the first half being situated between those of the second half of the display screen.

Because image lines which succeed one another on the screen do not succeed one another directly in time but are written 20 ms later, local flicker may arise due to a great difference in intensity between an image line and its interlaced direct neighbour, notably in the case of strong location-dependency of the intensity of the image.

FIGS. 4*c*, 4*d* illustrate how this effect can be counteracted. At the top of FIG. 4*c* there is shown a graph of the brightness profile containing an edge. Therebelow a low-pass filtered version of the profile is shown. FIG. 4*c* sampling points are indicated therein, sampling points of the interlaced raster being denoted by broken lines while the other points are denoted by solid lines. The edge is situated halfway between an interlaced sampling point and its neighhour. Consequently, flicker can be perceived in the image. FIG. 4*d* shows the situation desired in accordance with the invention. The brightness step is now concentrated between two sampling points of the same grid, so that the point on the interlaced grid has a mean brightness value halfway between these values, thus counteracting the flicker which would arise because the interlaced brightness value deviates from the environment and is written on a display screen separately in time from the other values.

It will be evident that the advantage of the method shown in FIG. 4*d* depends on the repetition frequency of the images. If this frequency is so high that no perceivable flicker occurs between the first part of the lines and the second, interlaced part, it will be more useful to concentrate the intensity step between an interlaced sampling point and its neighhour. However, if the image repetition frequency is low, it will have to be ensured notably that the interlaced image has a mean brightness amplitude between that of the lines of the first image.

Figure 5A:
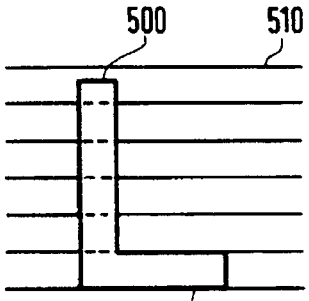
FIGS. 5*a*, 5*b* and 5*c* show various readjustments of a sampling grid in a two-dimensional sampling grid.
Figure 5B:
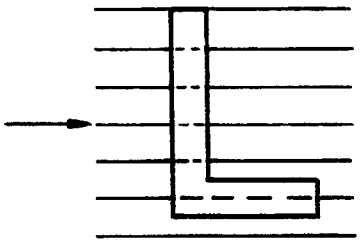
Figure 5C:
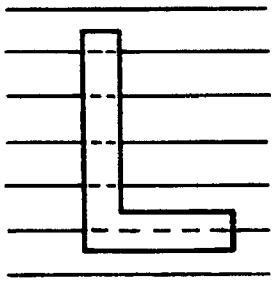

FIGS. 5*a*, 5*b* and 5*c* show the offsetting of the sampling points (sampling lines in the present case) for the brightness profile of a letter "L" (500) (by way of example) across which a grid 510 of sampling lines is shown. In FIG. 5*a*, a sampling line and the lower side 520 of the symbol coincide, corresponding to the situation of FIG. 4. In FIGS. 5*b* and 5*c* the situation desired for the lower side is created (like in FIG. 4*d*). In FIG. 5*b* the sampling line grid has been offset; in FIG. 5*c* the pitch has been adapted; as a result of both these steps, the lower edge is situated halfway between two sampling lines.

Figure 6:
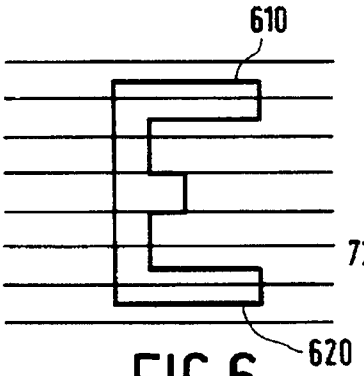
FIG. 6 shows the readjustment of a sampling grid in order that two parallel edges of a brightness profile be situated halfway between two pairs of sampling lines.
Figure 7:
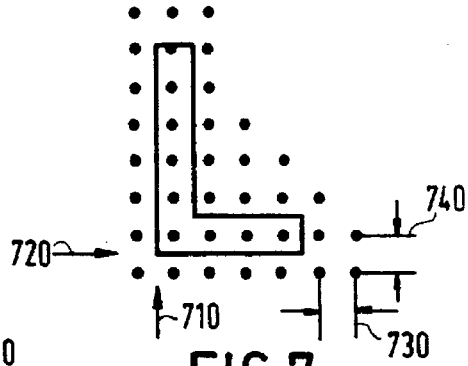
FIG. 7 shows the readjustment of the offset of a sampling grid in two directions extending transversely of one another.

Evidently, combinations of offset and pitch adaptation can also be used for this purpose. By combination of these two operations, if desired, even two different edges 610, 620 can be simultaneously positioned halfway between two sampling lines as shown in FIG. 6. In addition, as shown in FIG. 7, a vertical edge 710 can also be treated in this manner, provided of course that boundaries are present between image lines in a direction transversely of the horizontal direction, for example in that the image surface comprises pixels on a two-dimensional periodic raster. By performing the pitch adaptation in the horizontal direction 730 independently from that in the vertical direction 740, as many as four edges can thus be positioned between successive image lines (two horizontal edges and two other parallel edges extending transversely thereof).

In each of the above examples the pitch and/or the offset of the sampling grid has been adapted; evidently, the same effect can also be obtained by shifting or upscaling or downscaling the brightness profile.

Figure 8:
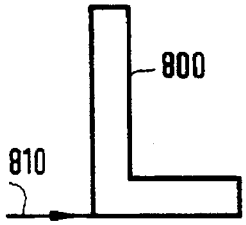
FIG. 8 shows a brightness profile comprising a reference line.

In order to carry out the method as illustrated by the foregoing Figures it is necessary for the position of the edge in the brightness profile to be known. In principle, it is possible to determine this position each time anew from the brightness profile, but it is advantageous to combine, as shown in FIG. 8, an indication 810 of the position of the edge with the brightness profile 800. For a set of symbols, such as a letter set, moreover, all brightness profiles can be realised so that the edges invariably occupy the same position; this offers the advantage that the readjustment can always be performed in the same way, regardless of the symbol of the set.

Figure 9:
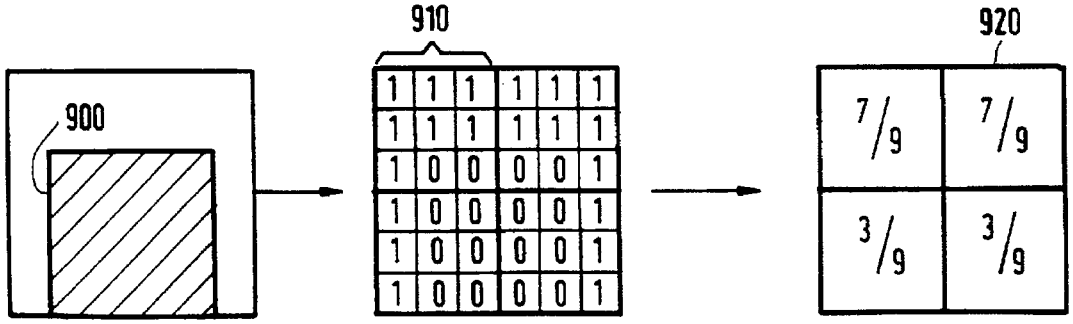
FIG. 9 illustrates the operation of a box filter.

It has been found that, when the brightness variations are concentrated in the described manner, a simple filter can be used without giving rise to artifacts. For the filter use can be made of, for example a so-called box filter as shown in FIG. 9. To this end, first the brightness profile 800 itself is sampled with a resolution which is higher than that of the sampling grid ultimately desired. In FIG. 9 this resolution is, for example a factor three higher. Subsequently, in blocks 910 of sampling points 900 the brightness value is averaged, resulting in the filtered values 920. Evidently, block shapes other than squares and factors other than three are also feasible, possibly in combination with weighting of the various amplitudes.

In conclusion the invention will be illustrated on the basis of results obtained for a series of letters while utilizing a box filter.

Figure 10A:
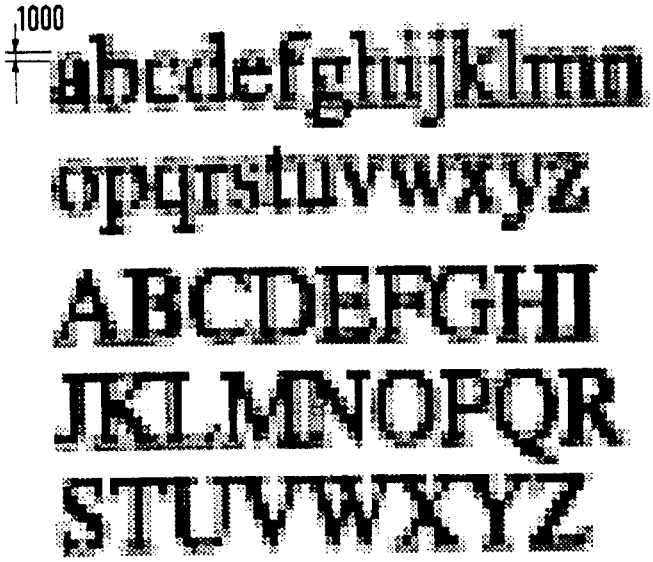
FIG.10a PRIOR ART
FIGS. 10*a*, 10*b* and 10*c* show the results of the prior art method and those of the method in accordance with the invention when applied to a set of letter symbols.

FIG. 10*a* shows results of application of the prior art method to a series of letters. Each sampling point is denoted by a square containing dots. The magnitude of the sampling points is denoted by arrows. The dots have the effect of a grey scale when viewed from a reasonable distance or when perceived through narrowed eyes.

Figure 10B:
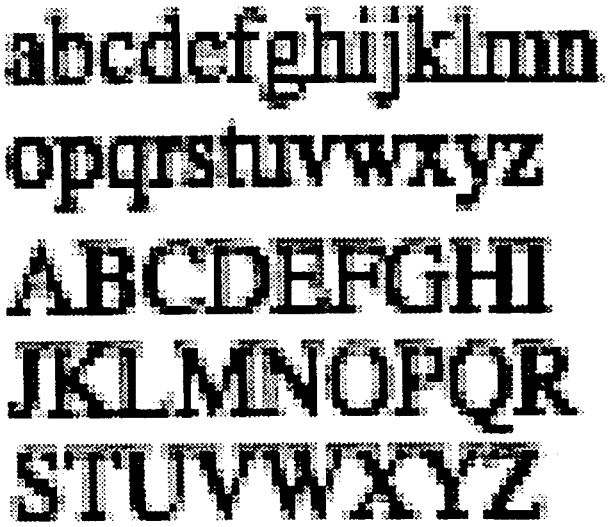

FIG. 10*b* shows the results of the application of a version of the method in accordance with the invention to the same symbols. It has been ensured that the lower edge of the symbols coincides with the boundary between successive samples. Moreover, all edges are situated at the boundary between the same sampling lines, resulting in a taut line as opposed to FIG. 10*a*.

Figure 10C:
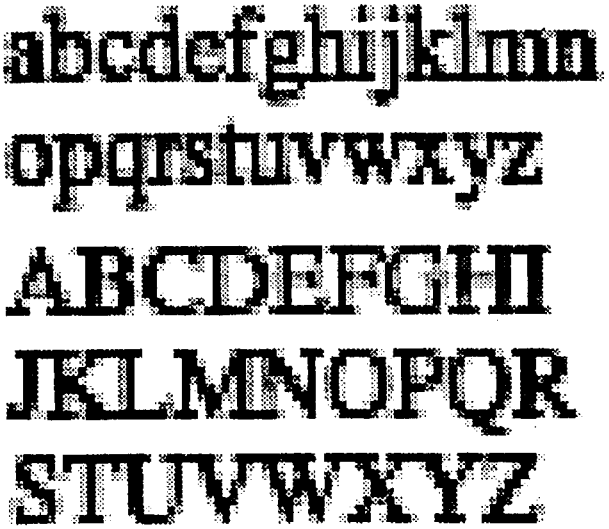

FIG. 10*c* shows the results of the application of a second version of the method in accordance with the invention. Through a combination of pitch and offset readjustment, a sharp lower and upper edge have been obtained. All edges at the boundary are again situated between pairs of sampling lines, resulting in a taut line.

I claim:

1. A method for reproducing, by means of raster image lines of a display apparatus, a multiplicity of symbols each represented by brightness amplitudes forming an ideal brightness profile which is more perfect than the raster image lines are capable of reproducing, said method comprising the steps of:

a. low-pass spatially filtering the ideal brightness profiles;

b. sampling the filtered profiles by means of a sampling grid having a succession of sampling lines which are movable relative to the profiles;

c. controlling the positions of the filtered profiles and the sampling lines in the grid relative to each other to locate for each one of said multiplicity of symbols being reproduced by said image lines of said display apparatus at least one maximum variation in the brightness amplitudes, which defines a respective edge for said each one of said multiplicity of symbols that is substantially parallel to the sampling lines, substantially midway between successively refreshed ones of said image lines; and d. varying the brightness of the image lines in response to samples produced by said sampling.

2. A method as in claim 1 where the positions of the sampling lines are controlled by changing the pitch of said sampling lines.

3. A method as in claim 1 where the positions of the sampling lines are controlled by changing the offset of said sampling lines.

4. A method as in claim 1 where the positions of the sampling lines in the grid are controlled to locate at least two of the maximum variations defining respective edges substantially midway between respective pairs of said successively refreshed image lines for each one of said multiplicity of symbols being reproduced by said image lines of said display apparatus.

5. A method as in claim 4 where the positions of the sampling lines are controlled by changing both the pitch and the offset of said sampling lines.

6. A method as in claim 1 where each of the sampling lines is formed by a series of sampling points.

7. A method as in claim 1 where the sampling grid has sampling lines oriented in a first direction and sampling lines oriented in a second direction transverse to said first direction.

8. A method as in claim 1 where the brightness amplitudes forming the ideal brightness profile have one of two possible values.

9. A method as in claim 8 where the brightness amplitudes represent typographic symbols and where the at least one maximum variation defines at least one of a base edge or a top edge of the respective symbol.

10. A method as in claim 8 where the brightness amplitudes represent typographic symbols and where the at least one maximum variation defines a side edge of the respective symbol.

11. A method as in claim 1 where the symbols each are represented by both brightness amplitudes and by a reference line indicator corresponding to said edge of said each symbol, the positions of the sampling lines being controlled to locate the reference line indicators halfway between said successively refreshed ones of the image lines.

12. A method as in claim 11 where a plurality of symbols having respective reference line indicators correspond to a common reference line.

13. A method as in claim 1 for reproducing a multiplicity of symbols by means of alternately produced first and second rasters with interlaced image lines, a first set of said successively refreshed image lines corresponding to image lines of the first raster and a second set of said successively refreshed image lines corresponding to image lines of the second raster.

14. A method as in claim 13 where said edge of the symbol is located substantially midway between successively refreshed image lines of the first set.

15. A method as in claim 1 where the positions of the filtered profiles and the sampling lines are controlled in response to the magnitudes of the samples of the filtered profiles.

16. A display apparatus for reproducing, by means of raster image lines of a display apparatus, a multiplicity of symbols each represented by brightness amplitudes forming an ideal brightness profile which is more perfect than the raster image lines are capable of reproducing, said apparatus comprising:

a. means for low-pass spatially filtering the ideal brightness profiles;

b. a sampling grid having a succession of sampling lines which are movable relative to the profiles for sampling the filtered profiles;

c. means for controlling the positions of the filtered profiles and the sampling lines in the grid relative to each other to locate for each one of said multiplicity of symbols being reproduced by said image lines of said display apparatus at least one maximum variation in the brightness amplitudes, which defines a respective edge for said each one of said multiplicity of symbols that is substantially parallel to the sampling lines, substantially midway between successively refreshed ones of said image lines; and d. means for varying the brightness of the image lines in response to samples produced by said sampling grid.

17. An improved method for reproducing a symbol on a raster display screen by means of image lines of pels, of the type wherein each pel may assume any one of at least three different possible brightness amplitudes and each brightness amplitude of a pel reproducing a portion of said symbol corresponds to a sampled value of a low-pass spatially filtered ideal brightness amplitude profile for said symbol, a desired position and pitch for said symbol on said display screen being specified, said improved method comprising the steps of:

determining a position in said spatially filtered ideal brightness amplitude profile corresponding to a maximum spatial variation of brightness amplitude, said determined position defining an edge of said symbol substantially parallel to said image lines;

before displaying said symbol, determining the positions that said image lines would have relative to said determined position of maximum spatial variation of brightness amplitude if said symbol were to be displayed exactly at said position specified for said symbol and exactly with the pitch specified for said symbol; and in the event said determined position of maximum spatial variation of brightness amplitude is not located substantially midway between two successively refreshed image lines of said display screen if said symbol were to be displayed exactly at said position and pitch specified for said symbol, adjusting the position and/or pitch at which said symbol is actually displayed, away from said position and pitch specified for said symbol, as needed, so as to locate said determined position of maximum spatial variation of brightness amplitude substantially midway between two successively refreshed image lines of said display screen, whereby the perceived quality of said displayed symbol is improved as a result of any said adjusting of the actual position and/or pitch at which said symbol is reproduced on said display screen.

18. An improved method as defined in claim 17 wherein said adjusting step is implemented by offsetting the actual position at which said symbol is displayed with respect to said position specified for said symbol in a direction transverse to said image lines.

19. An improved method as defined in claim 18 wherein said actual position is offset with respect to said position specified for said symbol by no greater than one half the spacing between said image lines.

20. An improved method as defined in claim 17 wherein said adjusting step is implemented, at least in part, by adjusting the size of said symbol with respect to a specified size.

21. An improved method as defined in claim 17 wherein said display screen is of the type having two interlaced rasters and the position and/or pitch at which said symbol is actually displayed is adjusted, as needed, so as to locate said determined position of maximum spatial variation of brightness amplitude substantially midway between two adjacent image lines of one of said rasters.

22. An improved method as defined in claim 17 wherein said display screen is of the non-interlaced raster type and the position and/or pitch at which said symbol is actually displayed is adjusted, as needed, so as to locate said determined position of maximum spatial variation of brightness amplitude substantially midway between two adjacent image lines.

23. An improved method as defined in claim 17 wherein a multiplicity of symbols are reproduced on said display screen and said adjusting step is implemented with respect to each symbol of said multiplicity of symbols reproduced on said display screen.

24. A display apparatus for reproducing a symbol on a raster display screen by means of image lines of pels, of the type wherein each pel may assume any one of at least three different possible brightness amplitudes and each brightness amplitude of a pel reproducing a portion of said symbol corresponds to a sampled value of a low-pass spatially filtered ideal brightness amplitude profile for said symbol, a desired position and pitch for said symbol on said display screen being specified, said apparatus comprising:

means for determining a position in said spatially filtered ideal brightness amplitude profile corresponding to a maximum spatial variation of brightness amplitude, said determined position defining an edge of said symbol substantially parallel to said image lines;

means for determining, before actual display of said symbol, the positions that said image lines would have relative to said determined position of maximum spatial variation of brightness amplitude if said symbol were to be displayed exactly at said position specified for said symbol and exactly with the pitch specified for said symbol; and means for adjusting the position and/or pitch at which said symbol is actually displayed away from said position and pitch specified for said symbol, in the event said determined position of maximum spatial variation of brightness amplitude is not located substantially midway between two successively refreshed image lines of said display screen if said symbol were to be displayed exactly at said position and pitch specified for said symbol, so as to locate said determined position of maximum spatial variation of brightness amplitude during actual display of said symbol substantially midway between two successively refreshed image lines of said display screen, whereby the perceived quality of said displayed symbol is improved as a result of said adjusting means adjusting the actual position and/or pitch at which said symbol is reproduced on said display screen.

25. A method for reproducing, by means of raster image lines of a display apparatus, a symbol represented by brightness amplitudes forming an ideal brightness profile which is more perfect than the raster image lines are capable of reproducing, said method comprising the steps of:

a. low-pass spatially filtering the ideal brightness profile;

b. sampling the filtered profile by means of a sampling grid having a succession of sampling lines which are movable relative to the profile;

c. controlling the positions of the filtered profile and the sampling lines in the grid relative to each other in dependence upon the position of at least one maximum variation in the brightness amplitudes, which defines a respective edge of the symbol that is substantially parallel to the sampling lines, relative to the position of the image lines so as to locate the at least one maximum variation in the brightness amplitudes substantially midway between successively refreshed ones of said image lines; and d. varying the brightness of the image lines in response to samples produced by said sampling.

26. A method as in claim 25 where the positions of the sampling lines are controlled by changing the pitch of said sampling lines.

27. A method as in claim 26 where the positions of the sampling lines are controlled by changing the offset of said sampling lines.

* * * * *